US006705830B2

(12) United States Patent
Yamashita et al.

(10) Patent No.: US 6,705,830 B2
(45) Date of Patent: Mar. 16, 2004

(54) VACUUM PUMP

(75) Inventors: Yoshihiro Yamashita, Chiba (JP); Yoshiyuki Sakaguchi, Chiba (JP); Yasushi Maejima, Chiba (JP)

(73) Assignee: BOC Edwards Techonlogies Limited, Narashino (JP)

( * ) Notice: Subject to any disclaimer, the term of this patent is extended or adjusted under 35 U.S.C. 154(b) by 17 days.

(21) Appl. No.: 10/131,643

(22) Filed: Apr. 23, 2002

(65) Prior Publication Data

US 2002/0172589 A1 Nov. 21, 2002

(30) Foreign Application Priority Data

Apr. 27, 2001 (JP) ..... 2001-131748

(51) Int. Cl.[7] ..... F04D 19/04
(52) U.S. Cl. ..... 415/9; 415/90; 415/213.1
(58) Field of Search ..... 415/9, 90, 126, 415/127, 128, 213.1, 214.1; 417/423.4

(56) References Cited

U.S. PATENT DOCUMENTS 6,485,254 B1 * 11/2002 Davis ..... 415/90
6,575,713 B2 * 6/2003 Ohtachi et al. ..... 417/423.4

FOREIGN PATENT DOCUMENTS

EP 0887556 12/1998
EP 1030062 8/2000

OTHER PUBLICATIONS

Patent Abstracts of Japan, vol. 1999, No. 01, Jan. 29, 1999, publication No. 10274189, publication date Oct. 13, 1998.
Patent Abstracts of Japan, vol. 1996, No. 09, Sep. 30, 1996, publication No. 08114196, publication date May 7, 1996.
Patent Abstracts of Japan, vol. 2000, No. 11, Jan. 3, 2001, publication No. 2000220596, publication date Aug. 8, 2000.
Patent Abstracts of Japan, vol. 2000, No. 10, Nov. 17, 2000, publication No. 2000205183, publication date Jul. 25, 2000.

* cited by examiner

*Primary Examiner*—Edward K. Look
*Assistant Examiner*—Richard A. Edgar
(74) *Attorney, Agent, or Firm*—Adams & Wilks

(57) ABSTRACT

A vacuum pump has an end portion and a flange extending from a periphery of the end portion. The flange portion has first and second opposed main surfaces, and first and second bolt insertion holes extending through the first and second main surfaces. An auxiliary ring is connected to the first main surface of the flange portion of the pump case. The auxiliary ring has first and second opposed main surfaces, and a third bolt insertion hole extending through the first and second main surfaces of the auxiliary ring. An auxiliary ring attaching bolt extends through the third bolt insertion hole for connecting the auxiliary ring to a chamber housing disposed opposite the end portion of the pump case. A pump case supporting bolt extends through the second bolt insertion hole of the pump case flange portion and is connected to the auxiliary ring, and a pump case fastening bolt extends through the first bolt insertion hole of the pump case flange portion and is connected to the auxiliary ring.

9 Claims, 5 Drawing Sheets

Prior Art (C PORTION ENLARGED VIEW)

Prior Art

VACUUM PUMP

BACKGROUND OF THE INVENTION

1. Field of the Invention

The present invention relates to a vacuum pump used for a semiconductor manufacturing apparatus, and particularly, to a structure for preventing defect accompanied by a damage of a fastening-bolt that connects the pump and a process chamber, which is caused due to damaging torque.

2. Description of the Related Art

A vacuum pump such as a turbo molecular pump is employed as means for exhausting gas in a chamber in such a step that processes are performed in a process chamber (hereinafter, referred to as "chamber") of high vacuum, such as a dry etching process of semiconductor manufacturing step or a CVD process.

FIG. 5 shows a conventional basic structure of this kind of vacuum pump. A pump case 1 of a vacuum pump shown in FIG. 5 is provided with a gas inlet port 2 at the upper surface and an exhaust pipe that serves as an exhaust port 3 at one side portion of the lower portion, is formed in a cylindrical-shape and is attached to a base 1—1.

The bottom portion of the base 1—1 is covered with an end plate 4, and a stator column 5 is provided so as to be erected at the center portion of internal bottom surface thereof.

A rotor shaft 7 is rotatably bore through an upper ball bearing 6 and a lower ball bearing 6 at the center of the stator column 5.

A driving motor 8 is arranged inside the stator column 5. The driving motor 8 has a structure in which a stator element 8*a* is disposed inside the stator column 5 and a rotator element 8*b* is disposed on the rotor shaft 8, and it is structured such that the rotor shaft 7 is rotated about the shaft.

A rotor 9, which covers the outer circumference of the stator column 5 and is formed in a section-shape, is connected to the upper portion protrusion end from the stator column 5 of the rotor shaft 7.

A plurality of rotor blades 10 and a plurality of stator blades 11, which are processed and formed in a blade-shape, are alternately disposed along the rotation center shaft of the rotor 9 between the upper portion side outer circumferential surface of the rotor 9 and the upper portion side inner wall of the pump case 1.

The rotor blades 10 are integrally processed with the rotor 9, to thereby be integrally provided with the upper portion side outer circumferential surface of the rotor 9. Further, the rotor blades 10 can be integrally rotated with the rotor 9. However, the stator blades 11 are positioned and arranged between the upper stage and the lower stage of the rotor blades 10, 10 through a spacer 11*a* positioned at the upper portion side inner wall of the pump case 1. Further, the stator blades 11 are attached and fixed to the inner wall side of the pump case 1.

A fixed screw stator 12 is arranged at the position opposing the lower portion side outer circumferential surface of the rotor 9. The screw stator 12 is formed in a cylindrical-shape so that the entire shape thereof surrounds the lower portion side outer circumferential surface of the rotor 9, and integrally attached and fixed to the base 1—1. Note that a thread groove is formed inside the screw stator 12, that is, at the surface side opposing the rotor 9.

The vacuum pump shown in FIG. 5 is employed as means for exhausting gas in the chamber 14 as described above.

However, in this used state, the vacuum pump shown in FIG. 5 is attached and fixed to the lower surface side opening portion of the chamber 14. In the pump-attached and fixed structure, there is adopted a structure in which a flange 1*a* that is integrally provided with the peripheral end portion of the upper surface of the pump case 1 hits on the peripheral end of the lower surface side opening portion of the chamber 14, and the flange 1*a* is fastened on the side of the chamber 14 by a plurality of bolts 15 in this state.

The operation of the above vacuum pump will be described. In the vacuum pump, an auxiliary pump (not shown) connected to the gas exhaust port 3 is operated to cause the inside of the chamber 14 to enter the vacuum state of some degree. Thereafter, the driving motor 8 is operated to rotate the rotor 9 and the rotor blades 10 at high speed integrated with the rotor shaft 7.

Thus, the rotor blade 10 of the uppermost stage rotating at high speed imparts downward momentum to gas molecule entered from the gas inlet port 2. The gas molecule including the downward momentum is guided to the stator blade 11 and sent into the side of the rotor blade 10 of the next lower stage. The above momentum impartment to gas molecule and the sending operation are repeated in a lot of stages. As a result, the gas molecule of the side of the gas inlet port 2 is sequentially moved to the inside of the screw stator 12 of the lower portion side of the rotor 9. The exhausting operation of the gas molecule is a gas molecule exhausting operation, which is caused due to interaction between the rotating rotor blades 10 and the fixed stator blades 11.

The gas molecule, which has reached the screw stator 12 of the lower portion side of the rotor 9 through the above-described gas molecule exhausting operation, is compressed by interaction between the rotating rotor 9 and the thread groove formed inside the screw stator 12, and is moved to the side of the gas exhaust port 3, and then is exhausted to the exterior through the auxiliary pump (not shown) from the gas exhaust port 3.

Incidentally, as structural materials of the rotor 9, the rotor blade 10, and the stator blade 11 or the like, which compose the vacuum pump, light alloy, in particular, aluminum alloy is normally employed in many cases. This is because aluminum alloy is excellent in machining and can be precisely processed without difficulty. However, the hardness of aluminum alloy is relatively low as compared with the other materials and aluminum alloy may cause a damage depending on the operating condition. Further, in a rotation body composed of the rotor 9 and the rotor blades 10, a minute drill hole is bored on the lower portion side outer circumferential surface of the rotor 9, to thereby keep the dynamic balance at the time of high-speed rotation. Consequently, there are tendencies for stress to concentrate on the drill hole, and for the damage of the rotor 9 to occur from the drill hole.

However, the conventional vacuum pump shown in FIG. 5 adopts the pump-attached and fixed structure in which the flange 1*a* of the pump case 1 is connected to the side of the chamber 14 by the bolt 15, as described above. Therefore, for example, the above damage of the rotor 9 occurs during the high-speed rotation of the rotor 9, to thereby generate a high rotation torque (hereinafter, referred to as "damaging torque") for rotating the entire pump case 1. Thus, the distortion of the pump case 1 is caused due to the damaging torque and a bolt shaft portion 15*a* of the bolt 15 fails due to the distortion force as shown in FIG. 6, resulting in causing such a defect that the entire pump together with the pump case 1 is released and dropped from the side of the chamber 14. Also, it takes a lot of time to take out the failed bolt shaft 15*a* of the bolt 15 from the side of the chamber 14. In the worst case, it is necessary that a new tap is built and a new screw hole is provided at the side of the chamber 14. Therefore, the pump changing operation is performed with difficulty.

The present invention is made for solving the above described problems and an object of the present invention is to provide a vacuum pump in which dropping of the pump and troubles accompanied therewith can be prevented in advance even when an abnormality of the pump occurs only to generate damaging torque, and the changing operation of the pump causing the abnormality can be rapidly performed.

SUMMARY OF THE INVENTION

To attain the above described object, according to the present invention, there is provided a vacuum pump comprising: a pump case forming an inlet port at an upper surface; a rotor provided rotatably in the pump case; a rotor blade provided integrally with an outer circumferential surface of the rotor; a stator blade positioned and arranged between the rotor blades or at the outside thereof; and a driving motor for rotating the rotor, characterized in that a step is provided at a peripheral end portion of an upper surface of the pump case to form a flange portion, and further the vacuum pump comprises: an auxiliary ring attached and fit to an upper surface of the flange portion, the surface of which is integrated with the upper surface of the pump case; a bolt insertion hole formed so as to pass through an upper surface and a lower surface of the auxiliary ring; a first bolt insertion hole and a second bolt insertion hole formed so as to pass through the upper surface and the lower surface of the flange portion; an auxiliary ring attaching bolt inserted into the bolt insertion hole of the auxiliary ring, screwed in and fixed to the lower portion opening peripheral end of a chamber positioned at the side opposing the upper surface of the pump case; a pump case supporting bolt inserted into the first bolt insertion hole of the flange portion, screwed in and fixed to the auxiliary ring for supporting the pump case; and a pump case fastening bolt inserted into the second bolt insertion hole of the flange portion, screwed in and fixed to the auxiliary ring for fixing the pump case, and a shaft diameter of which being set small as compared with the auxiliary ring attaching bolt and the pump case supporting bolt.

According to the above structure, in the present invention, when damaging torque is generated, a narrow pump fastening bolt as compared with an auxiliary ring attaching bolt and the pump supporting bolt fails from the relationship with respect to the shaft diameter difference to absorb the shock. Then, a pump connected by a pump supporting bolt rotates to cause bending force and shearing force to act on the pump case supporting bolt. The pump supporting bolt is deformed due to such a force, but prevents a damage thereof, and receive the force. The projecting portion of the auxiliary ring attaching bolt is smaller than that of the pump case supporting bolt, and is tightly fastened. Consequently, the normal state can be maintained and the pump-changing-operation after the pump abnormality occurs can be rapidly performed.

The present invention can adopt a structure in which the pump case is formed in a cylindrical-shape, the first bolt insertion hole is constituted of a long hole, a longitudinal direction of which is the circumferential direction of the pump case, and the pump case supporting bolt is inserted into the long hole and screwed in and fixed to the auxiliary ring, and fastening force thereof is set to be smaller than that of the pump case fastening bolt.

According to the structure, even when the pump case fastening bolt fails, the case supporting bolt moves relatively in the circumferential direction of the pump case and is deformed but is prevented from failing. As a result, even when the all of the pump case fastening bolts are damaged, the pump can be prevented from dropping.

The present invention may adopt a structure in which the pump case supporting bolt is attached to a flange through a plain washer and a spring washer. Therefore, the fastening force becomes adjustable in accordance with the amount of deformation of the spring washer, thereby being capable of relatively moving in the circumferential direction.

DETAILED DESCRIPTION OF THE PREFERRED EMBODIMENT

Figure 5:
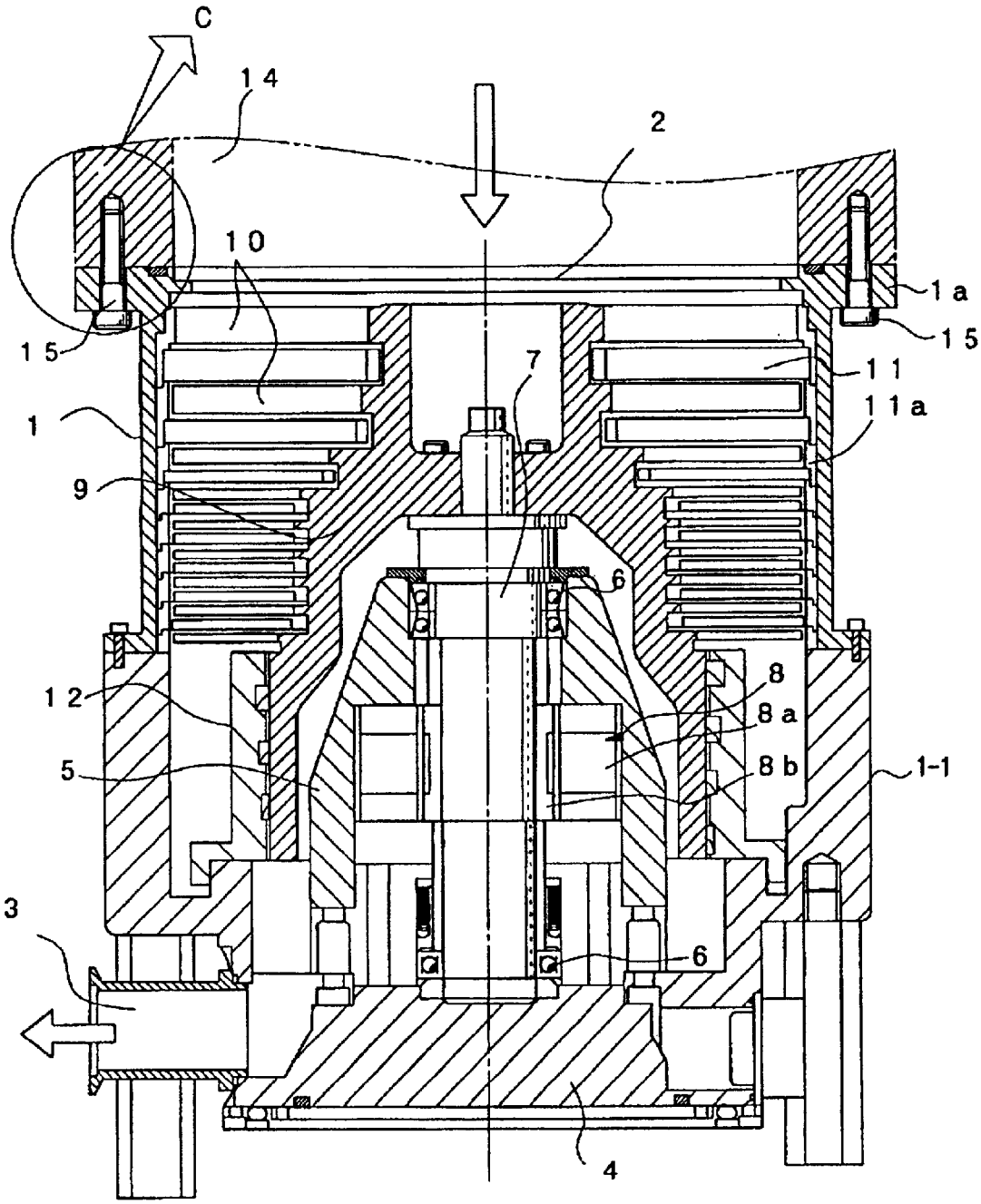
FIG. 5 is a longitudinal sectional view showing the overall structure of the conventional vacuum pump.
Figure 6:
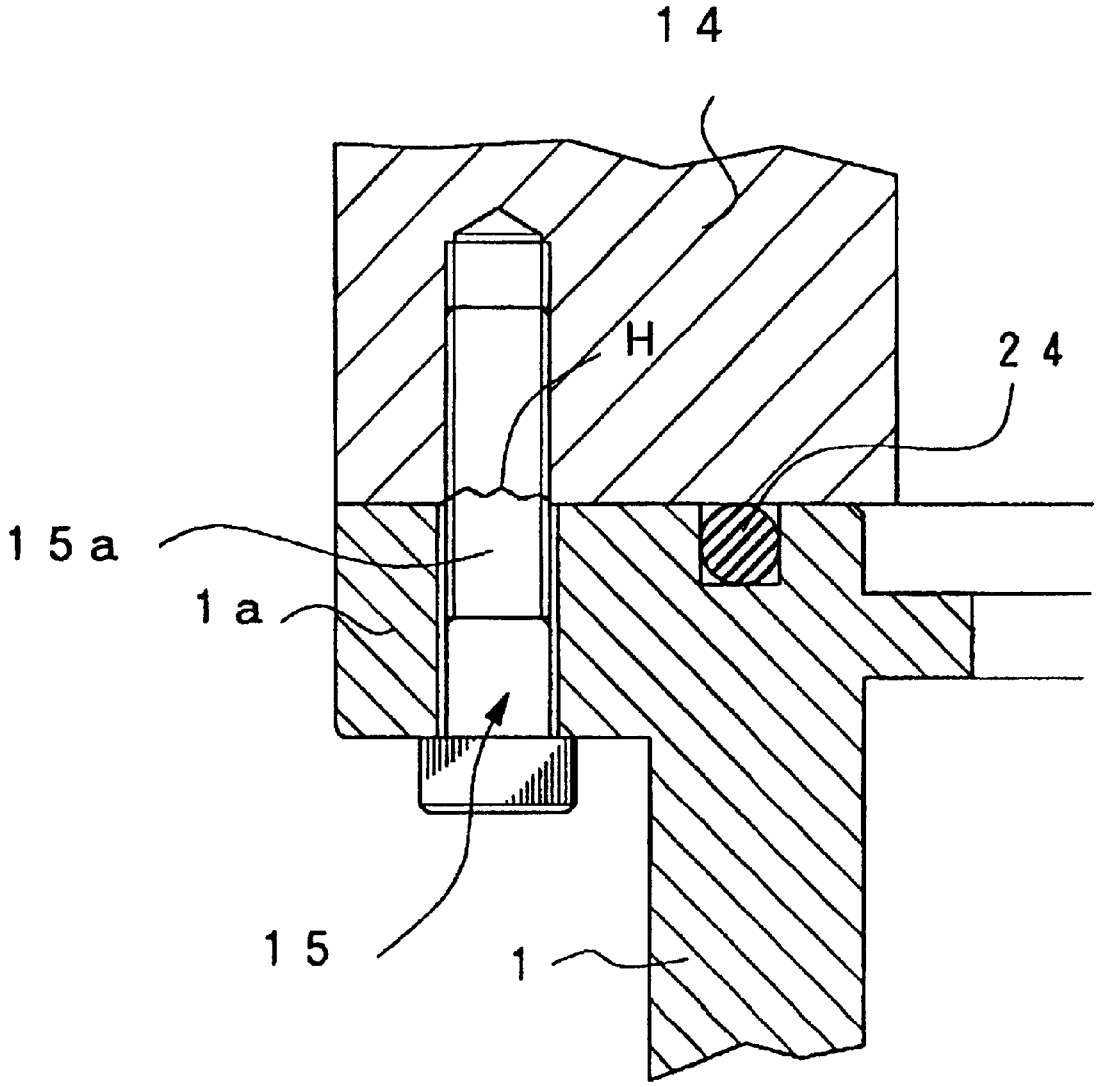
FIG. 6 is a partial sectional view showing an enlarged C portion of FIG. 5.

The preferable embodiment of the present invention will be described below in detail with reference to the attached drawings. Incidentally, the basic structure of a vacuum pump is same as that of the conventional pump shown in FIG. 5. Therefore, the entire explanation will be omitted and the same numerals and symbols will be used to designate the same components and the different symbols will be employed to designate only the necessary components in the description.

Figure 1:
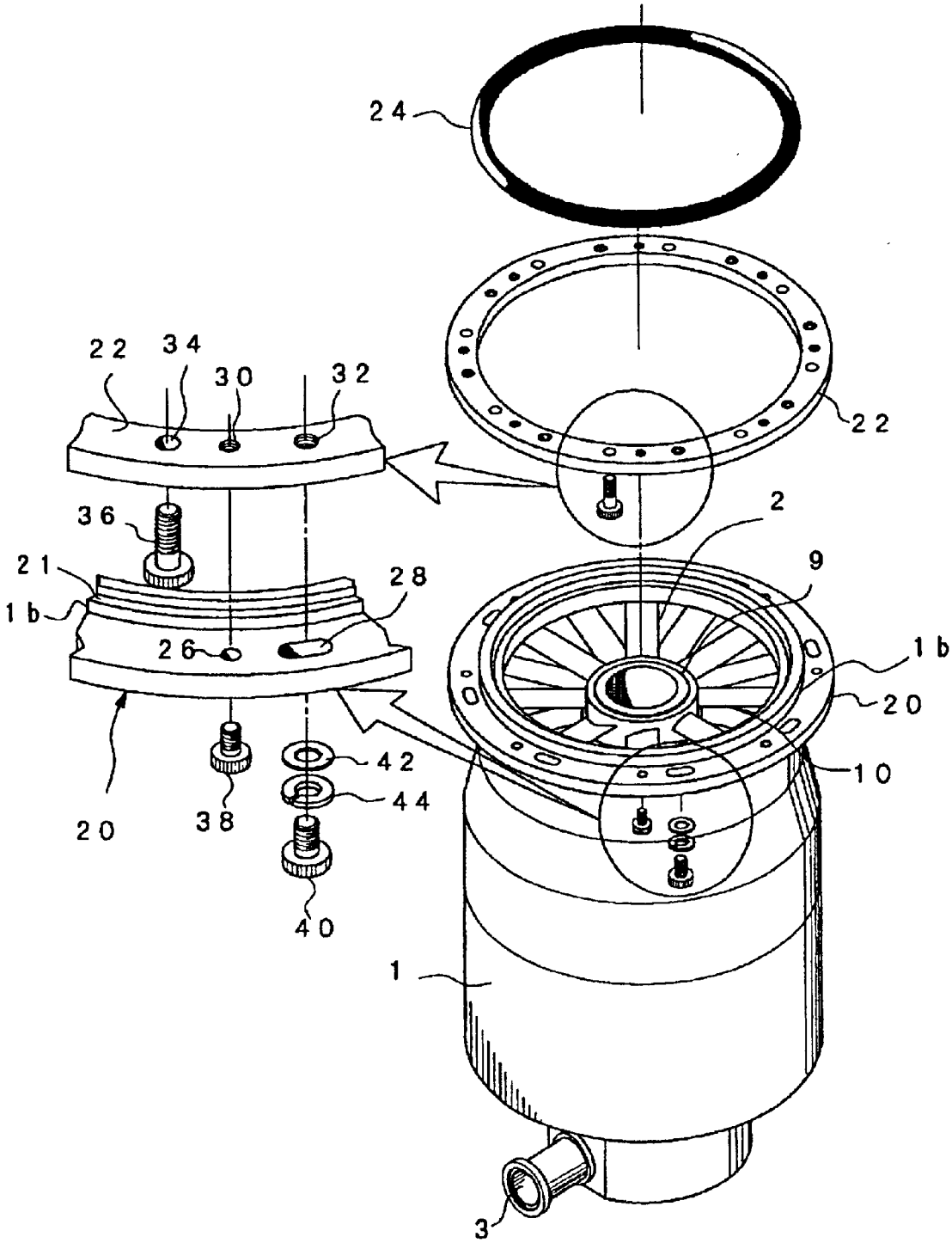
FIG. 1 is a partially enlarged exploded perspective view showing the entire of a vacuum pump according to the present invention.
Figure 2:
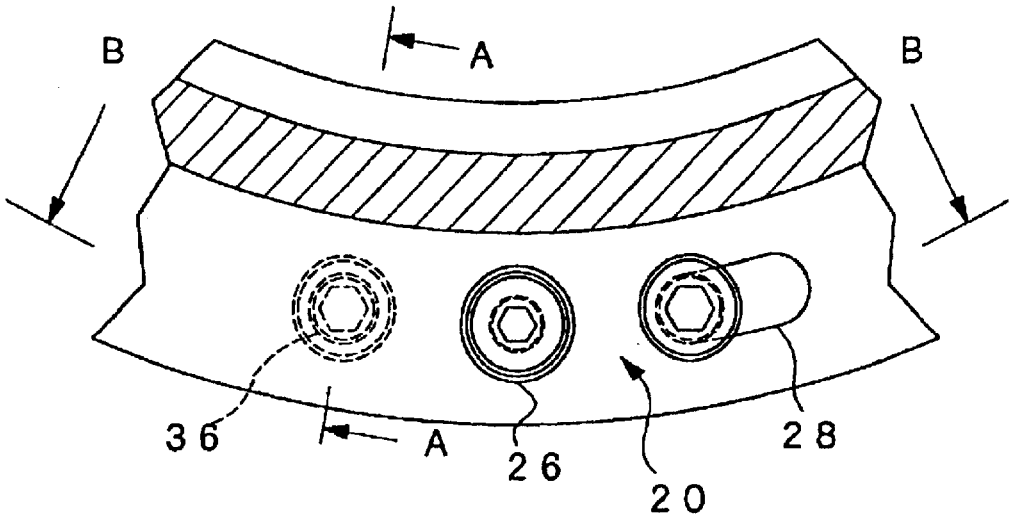
FIG. 2 is a partial plan view showing a flange portion as viewed from the bottom surface side.
Figure 3:
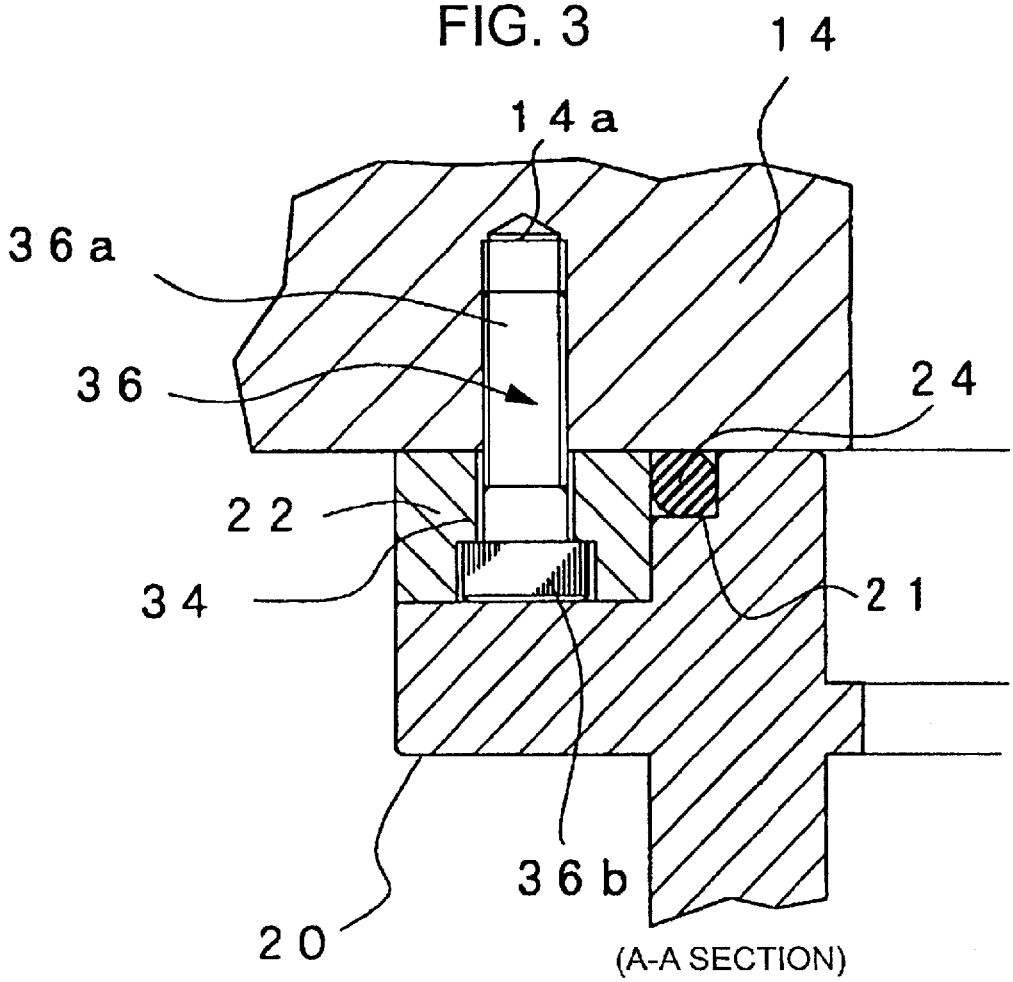
FIG. 3 is a sectional view taken along the A—A line of FIG. 2.

FIGS. 1 to 4 shows an embodiment of a vacuum pump according to the present invention. FIG. 1 is an exploded perspective view showing the entire structure. FIG. 2 is a partial plan view of a flange portion as viewed from the bottom portion side. FIG. 3 is a sectional view taken along the A—A line of FIG. 2. FIG. 4A is a sectional view taken along the B—B line of FIG. 2 and FIG. 4B is an explanatory view of the operation thereof.

In the figure, a step 1*b* is provided at the upper surface peripheral end of a pump case 1 to form a flange portion 20. An auxiliary ring 22, the surface of which is integrated with the upper surface of the pump case 1, is provided so as to be fitted on the upper surface of the flange portion 20.

An O-ring attaching portion 21 for setting an O-ring 24 is formed outside the uppermost surface of the pump case 1. The O-ring attaching portion 21 serves as a groove in which the O-ring 24 is fitted in a state where the auxiliary ring 22 is fitted.

The flange portion 20 is provided with a bolt insertion hole (clearance hole) 26 (first bolt insertion hole) that passes through the upper surface and the lower surface thereof and has a small diameter, and is provided with a long hole (clearance hole) 28 (second bolt insertion hole) forming a pair in the vicinity thereof, a longitudinal direction of which is the circumferential direction of the pump case 1, so as to pass through the upper surface and the lower surface of the flange portion 20.

The auxiliary ring 22 is provided with a first screw hole 30 and a second screw hole 32 so as to pass through the upper surface and the lower surface thereof. The first screw hole 30 is provided at the position opposing the bolt insertion hole 26 having a small diameter. The second screw hole 32 is provided at the position opposing the long hole 28. Further, the auxiliary ring 22 is provided with a bolt insertion hole 34 (third bolt insertion hole) so as to pass through the upper surface and the lower surface thereof. The bolt insertion hole 34 is provided in the vicinity of the first screw hole 30 and the second screw hole 32.

A pair of the bolt insertion hole 26 (hereinafter, referred to as "small-diameter bolt insertion hole") having a small diameter and the long hole 28 is formed at eight positions of the periphery of the flange portion 20 at a same interval in the present embodiment as described above. However, a pair of these holes can be provided at approximately 12 positions in accordance with the diameter of the flange portion 20. The same applies to a pair of the screw holes 30, 32 and the bolt insertion hole (clearance hole) 34, which are formed at the side of the auxiliary ring 22.

An auxiliary ring attaching bolt 36 for attaching the auxiliary ring 22 to a chamber housing 14 is inserted into the bolt insertion hole 34 of the auxiliary ring 22. In the auxiliary ring attaching bolt 36, a bolt shaft 36*a* that protrudes at the upper portion is screwed in a female thread portion 14*a* formed at the lower portion opening peripheral end of the chamber housing 14, to thereby fix the auxiliary ring 22 to the lower portion opening peripheral end of the chamber housing 14. In this case, the chamber housing 14 is positioned at the side opposing the upper surface of the pump case 1.

A pump case fastening bolt 38 for fastening the flange portion 20 with respect to the auxiliary ring 22 is inserted into the bolt insertion hole 26 of the flange portion 20, which has a small diameter. The pump case fastening bolt 38 takes a structure in which a bolt shaft 38*a* thereof is screwed in and fixed to the first screw hole 30 formed in the auxiliary ring 22.

A pump case supporting bolt 40 is inserted into the long hole 28 of the flange portion 20 through a plain washer 42 and a spring washer 44. The pump case supporting bolt 40 has a structure in which a bolt shaft 40*a* thereof is screwed in and fixed to the second screw hole 32 of the auxiliary ring 22. The pump case supporting bolt 40 mainly functions as means for maintaining a state where the entire pump case 1 including the flange portion 20 is securely supported at the side of the auxiliary ring 22.

In the above structure, the shaft diameter of the auxiliary ring attaching bolt 36 is substantially the same as that of the pump case supporting bolt 40, and the shaft diameter of the pump case fastening bolt 38 is set smaller than those of the auxiliary ring attaching bolt 36 and the pump case supporting bolt 40. Also, the fastening force of the pump case supporting bolt 42 is set smaller than that of the pump case fastening bolt 38. Further, the present embodiment adopts a structure in which the plain washer 42 and the spring washer 44 are provided between a bolt top portion 40*b* of the pump case supporting bolt 40 and the bottom surface of the flange portion 20, to thereby allow the flange portion 20 of the pump case 1 to relatively slide with respect to the pump case supporting bolt 40 by a clearance of the long hole 28.

Figure 4A:
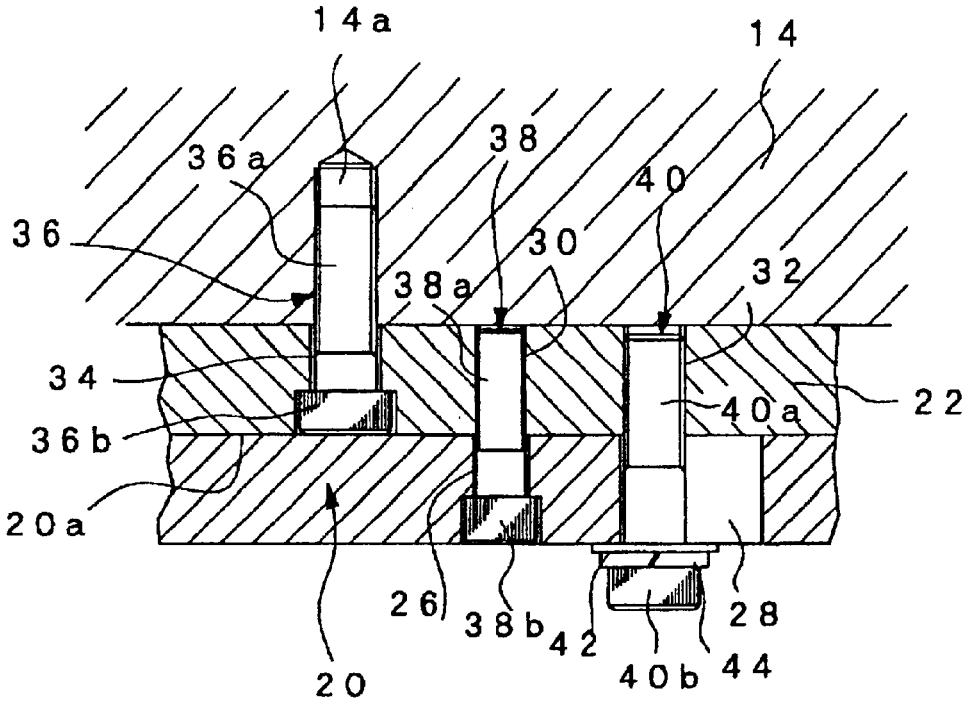
FIGS. 4A and 4B are respectively a sectional view and an explanatory view showing the operation, which are taken along the B—B line of FIG. 2.
Figure 4B:
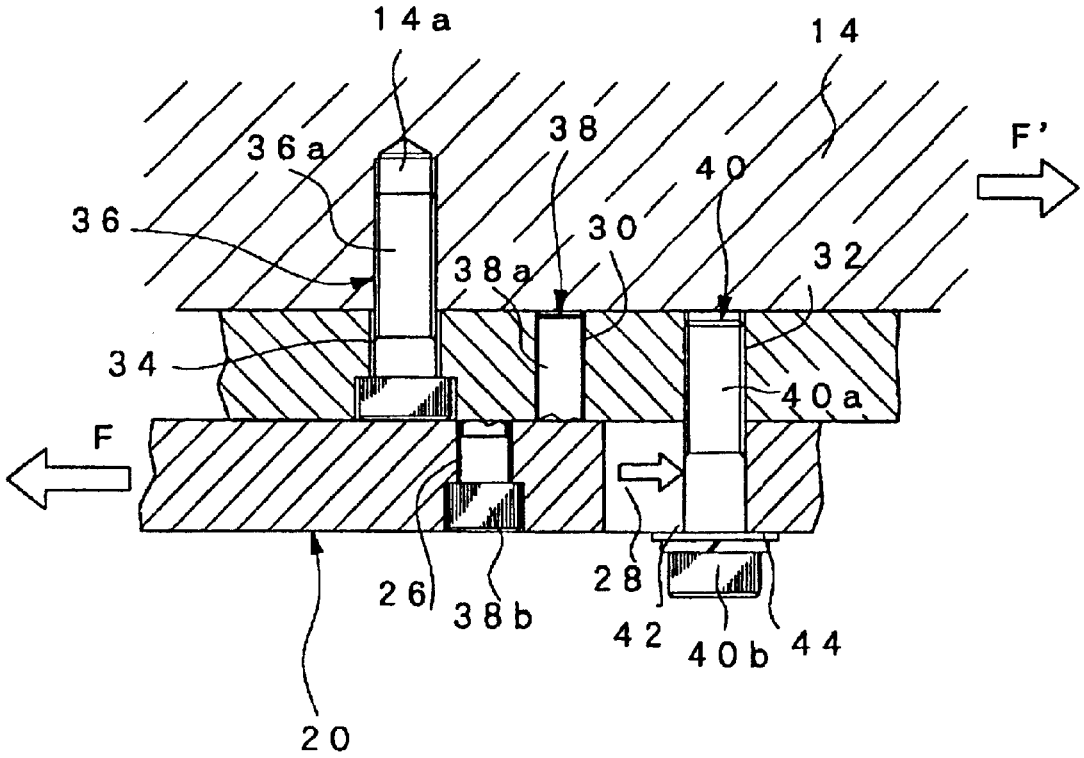

In the above structure, in the case where an abnormality of the vacuum pump occurs only to cause a damage of the rotor 9, torque F of the circumpherential direction is generated in the pump case 1, and instantaneous shearing force acts on each of the pump case fastening bolt 38 having a small diameter and the auxiliary ring attaching bolt 36, and consequently a damage of the pump case fastening bolt 38 having a small diameter occurs in the boundary surface between the auxiliary ring 22 and the flange portion 20, as shown in FIG. 4B.

When a damage of the above pump case fastening bolt 38 having a small diameter is completely performed, the flange portion 20 moves by the clearance of the long hole 28 while being supported at the side of the auxiliary ring 22 by the case supporting bolt 40, to thereby reduce a damaging energy. Consequently, the flange portion 20 hits on the pump case supporting bolt 40 only to deform the pump case supporting bolt 40, and is stopped.

Accordingly, even when the entire pump case fastening bolt 38 fails, the state can be maintained in which the pump case 1 is supported at the lower portion of the chamber 14 through the case supporting bolt 40 and the auxiliary ring attaching bolt 36.

After the abnormality of the vacuum pump occurs, as described above, the pump case supporting bolt 40 is taken out of the flange portion 20 to remove the vacuum pump from the chamber 14, and then the auxiliary ring attaching bolt 36 is taken out of the auxiliary ring 22 to thereby allow an attachment of a new vacuum pump.

Note that in the above embodiment, the inside of the bolt insertion hole 34 is constituted of a hole having a stage, so that the bolt top portion 36*b* of the auxiliary ring attaching bolt 36 is fitted in the auxiliary ring 22 as shown in FIGS. 3 to 4. However, it may be structured such that the bolt top portion 36*b* is protruded from the lower portion of the auxiliary ring 22 and a hole for receiving the bolt top portion 36*b* is bored at the side of the flange portion 20. In a similar manner, the inside of the bolt insertion hole 26 is constituted of a hole having a stage, so that the bolt top portion 38*b* of the pump case fastening bolt 38 is fitted in the flange portion 20, however, it may be structured such that the bolt top portion 38*b* is protruded from the bottom portion side of the flange 20.

There is made a description of the example in which the present invention is applied to the turbo molecular pump in the above embodiment. However, the present invention is applicable to the other pumps using rotation, such as a drag pump or the like. Also, in addition to a ball bearing, a magnetic bearing, an air bearing or the like may be employed for the bearing of the rotor shaft 7.

As clearly described above, according to the vacuum pump of the present invention, there is adopted a structure in which when an abnormality of a pump occurs only to generate damaging torque, an auxiliary ring connecting bolt having a small shaft diameter fails to absorb shock thereof. Therefore, a chamber attaching bolt and a pump case supporting bolt, each of which has a shaft diameter larger than that of the auxiliary ring connecting bolt, can be maintained in the normal state. Also, even when a pump case connecting bolt fails, the state can be maintained in which a pump case is supported at the lower portion of a chamber through the pump case supporting bolt and an auxiliary ring attaching bolt. Further, it can prevent dropping of the pump or troubles accompanied therewith. Additionally, these normal bolts are removed to thereby perform a rapid pump changing operation after the abnormality of the pump occurred.

What is claimed is:

1. A vacuum pump comprising:

a pump case having an inlet port at an end portion thereof and a flange portion extending from a periphery of the end portion, the flange portion having a first main surface, a second main surface disposed opposite the first main surface, a first bolt insertion hole extending through the first and second main surfaces, and a second bolt insertion hole extending through the first and second main surfaces;

a rotor disposed in the pump case for undergoing rotation;

a plurality of rotor blades integrally connected to an outer circumferential surface of the rotor;

a stator having a plurality of stator blades disposed between the rotor blades;

a driving motor for rotationally driving the rotor;

an auxiliary ring connected to the first main surface of the flange portion of the pump case, the auxiliary ring having a first main surface, a second main surface disposed opposite the first main surface, and a third bolt insertion hole extending through the first and second main surfaces of the auxiliary ring;

an auxiliary ring attaching bolt extending through the third bolt insertion hole for connecting the auxiliary ring to a chamber housing disposed opposite the end portion of the pump case;

a pump case supporting bolt extending through the second bolt insertion hole of the flange portion of the pump case and connected to the auxiliary ring; and a pump case fastening bolt extending through the first bolt insertion hole of the flange portion of the pump case and connected to the auxiliary ring, a shaft portion of the pump case fastening bolt having a diameter smaller than a shaft portion of each of the auxiliary ring attaching bolt and the pump case supporting bolt.

2. A vacuum pump according to claim 1; wherein the pump case is generally cylindrical-shaped and the first bolt insertion hole comprises a long hole having a length extending in a circumferential direction of the pump case; and wherein the pump case supporting bolt has a smaller fastening force than a fastening force of the pump case fastening bolt.

3. A vacuum pump according to claim 2; further comprising a plain washer and a spring washer disposed between a head portion of the pump case supporting bolt and the second main surface of the flange portion of the pump case.

4. A vacuum pump comprising:

a pump case having an end portion and a flange portion extending from a periphery of the end portion, the flange portion having a first main surface, a second main surface disposed opposite the first main surface, a first bolt insertion hole extending through the first and second main surfaces, and a second bolt insertion hole extending through the first and second main surfaces;

an auxiliary ring connected to the first main surface of the flange portion of the pump case, the auxiliary ring having a first main surface, a second main surface disposed opposite the first main surface, and a third bolt insertion hole extending through the first and second main surf aces of the auxiliary ring;

an auxiliary ring attaching bolt extending through the third bolt insertion hole for connecting the auxiliary ring to a chamber housing disposed opposite the end portion of the pump case;

a pump case supporting bolt extending through the second bolt insertion hole of the flange portion of the pump case and connected to the auxiliary ring; and a pump case fastening bolt extending through the first bolt insertion hole of the flange portion of the pump case and connected to the auxiliary ring, the pump case fastening bolt having a shaft portion having a diameter smaller than that of a shaft portion of each of the auxiliary ring attaching bolt and the pump case supporting bolt.

5. A vacuum pump according to claim 4; wherein the pump case is generally cylindrical-shaped and the first bolt insertion hole is longer in a circumferential direction of the pump case than in a radial direction of the pump case; and wherein the pump case supporting bolt has a smaller fastening force than a fastening force of the pump case fastening bolt.

6. A vacuum pump according to claim 4; wherein the pump case has a step portion extending from the flange portion; and further comprising a sealing member disposed on a circumferential surface of the step portion for providing a liquid seal between the flange portion, the auxiliary ring and the chamber housing.

7. A vacuum pump according to claim 6; wherein the sealing member comprises an O-ring.

8. A vacuum pump according to claim 4; further comprising a plain washer and a spring washer disposed between a head portion of the pump case supporting bolt and the second main surface of the flange portion of the pump case.

9. A vacuum pump according to claim 4; wherein each of the pump case supporting bolt and the pump case fastening bolt has a threaded shaft portion for threaded engagement with a corresponding threaded hole in the auxiliary ring.

* * * * *